US005591042A

United States Patent [19]

Takata et al.

[11] Patent Number: 5,591,042

[45] Date of Patent: Jan. 7, 1997

[54] CONNECTOR ASSEMBLY

[75] Inventors: Kensaku Takata; Satoshi Takano, both of Osaka; Nori Inoue, Yokkaichi; Mitsuru Itoh, Yokkaichi; Hitoshi Okumura, Yokkaichi; Masaji Suzuki, Yokkaichi, all of Japan

[73] Assignees: Sumitomo Electric Industries, Ltd., Osaka; Sumitomo Wiring Systems, Ltd., Yokkaichi, both of Japan

[21] Appl. No.: 548,472

[22] Filed: Oct. 26, 1995

[30] Foreign Application Priority Data

Oct. 27, 1994 [JP] Japan ..... 6-263620
Nov. 22, 1994 [JP] Japan ..... 6-288096

[51] Int. Cl.[6] ..... H01R 13/73

[52] U.S. Cl. ..... 439/354; 439/157

[58] Field of Search ..... 439/157, 159, 439/345, 350, 354, 357; 403/405.1, 409.1

[56] References Cited

U.S. PATENT DOCUMENTS 5,246,380 9/1993 Kodama ..... 439/354
5,376,014 12/1994 Sumida ..... 439/352 X

FOREIGN PATENT DOCUMENTS 64-51276 3/1989 Japan .
3-19273 2/1991 Japan .
4-47285 4/1992 Japan .
4-306575 10/1992 Japan .
5-74521 3/1993 Japan .
5-121121 5/1993 Japan .
5-53157 7/1993 Japan .

*Primary Examiner*—Khiem Nguyen
*Attorney, Agent, or Firm*—Wenderoth, Lind & Ponack

[57] ABSTRACT

A connector assembly with a bad-connection-preventive function is disclosed. It is simple in structure, made up of a small number of parts, and has high long-term reliability. It has a second connector having an integral locking arm and a first connector. Protrusions A and B are formed on side faces of the locking arm and the side faces of the first connector, respectively. A spring is mounted in the first connector. By inserting the second connector into the first connector, the locking arm is pushed upward by the protrusions B, so that its shoulder portion abuts the spring. Thus, the spring is compressed when the second connector is further pushed into the first connector. The connectors are thus urged in a direction away from each other by the spring. The spring disengages when the connectors are completely coupled together. When pulling the second connector out of the first connector, the protrusions A pass under the protrusions B.

4 Claims, 4 Drawing Sheets

1
2
3
5
6
7
8
A
B
C

CONNECTOR ASSEMBLY

BACKGROUND OF THE INVENTION

This invention relates to a connector assembly with a locking means for connecting electric wires and optical fibers which are especially suited for use with a high-reliability circuit.

Among conventional connector assemblies comprising a first connector and a second connector to be inserted in the first connector and having a locking means provided with an engaging member adapted to engage the first connector when the second connector is completely inserted into the first connector, thereby locking the connectors in the coupled state, there are ones having means for preventing incomplete connection of the connectors. The following documents disclose this type of connector assemblies:

① Unexamined Japanese Utility Model Publication 64-51276

② Unexamined Japanese Utility Model Publication 3-19273

③ Unexamined Japanese Utility Model Publication 61-99381

④ Unexamined Japanese Patent Publication 4-47285

⑤ Unexamined Japanese Patent Publication 5-74521

⑥ Unexamined Japanese Utility Model Publication 4-306575

⑦ Unexamined Japanese Utility Model Publication 5-43484

⑧ Unexamined Japanese Utility Model Publication 5-53157

⑨ Unexamined Japanese Patent Publication 5-121121

In these prior arts, spring force is applied to the connectors to urge them apart from each other when the second connector is pushed into the first connector. Thus, if the connection is incomplete, the second connector is pushed out of the first connector by the spring, so that an operator can see that the connection is incomplete.

But these connector assemblies have one problem or other. Namely, for the connector assemblies disclosed in publications ① and ②, there is a possibility that the second connector may not be completely pushed out of the first connector even if the connection is incomplete. Thus, an operator may overlook such incompletely connected connectors.

For the connector assemblies disclosed in publications ③, ④, and ⑤, the spring remains compressed even after the connectors have been coupled together, so that the connector housing tends to suffer creep deformation under the force of the compressed spring.

The connector assemblies disclosed in publications ⑥ to ⑨ are free of creep deformation because the spring is adapted to disengage and return to its rest position. But these connectors are all complicated in structure, and consist of a large number of parts, so that it is troublesome and costly to assemble them.

An object of the present invention is to solve these problems.

SUMMARY OF THE INVENTION

According to the present invention, there are provided the following two kinds of connector assemblies:

(1) A connector assembly comprising a first connector and a second connector having an integral, resiliently deformable locking arm and adapted to be inserted in the first connector, the locking arm having a shoulder portion and protrusions A on side surfaces thereof, the first connector having protrusions B on its surfaces that face the side surfaces when the second connector is inserted into the first connector, the protrusions B having top surfaces and bottom surfaces and being adapted to guide the protrusions A up onto the top surfaces when the second connector is inserted into the first connector, a spring mounted in the first connector and arranged so as to abut the shoulder portion of the locking arm when the protrusions A have been guided onto the top surfaces of the protrusions B, and to be compressed when the second connector is further pushed into the first connector, the protrusions A passing over the protrusions B and engaging inner ends of the protrusions B, and the shoulder portion disengaging from the spring when the second connector has been inserted completely into the first connector, the first connector having such a space as to allow the protrusions A to pass under the bottom surfaces of the protrusions B when the second connector is pulled out of the first connector while pressing down a free end of the locking arm.

(2) A connector assembly comprising a first connector and a second connector having a resiliently deformable locking arm and adapted to be inserted in the first connector, the locking arm having protrusions A on side surfaces thereof, the first connector having an integral resilient arm provided with protrusions B on side surfaces thereof, the protrusions B being adapted to be pushed down by the protrusions A to allow passage of the protrusions A when the second connector is inserted into the first connector, a spring mounted in the second connector and arranged so as to abut one end of the resilient arm when the protrusions A have been pushed down by the protrusions B, and to be compressed when the second connector is further pushed into the first connector, the protrusions A passing over the protrusions B and engaging inner ends of the protrusions B, and the resilient arm disengaging from the spring when the second connector has been inserted completely into the first connector, the first connector having such a space as to allow the protrusions A to pass under the protrusions B when the second connector is pulled out of the first connector while pressing down a free end of the locking arm.

By inserting the second connector, the locking arm is guided upward by the protrusions B and engages the spring (first embodiment), or the resilient arm of the first connector is pushed down by protrusions A and engages the spring (second embodiment). By further pushing the second connector into the first connector from this position (position A), the spring is compressed by the second connector. Thus, if the connection between the first and second connectors is incomplete, the second connector will be pushed out of the first connector by the spring to position A, so that an operator can easily find any incompletely connected connector without fail.

When the second connector is fully inserted into the first connector, the locker arm (in the first embodiment) or the resilient arm (in the second embodiment) resiliently returns to its original position, disengaging from the spring. Namely, the second connector is freed from the force of the spring, so that the connector housing is less likely to suffer creep deformation. This improves the long-term reliability of the connector assembly.

The locking arm and the protrusions A (first embodiment) are integral parts of the second connector. The protrusions B and the resilient arm (second embodiment) are integral parts of the first connector. The spring is the only member that is separate from both connectors. Such a connector assembly, consisting of only three separate members, is easy to assemble and thus can be manufactured at a low cost.

When pulling the second connector out of the first connector, the protrusions A are guided through such a course that the locking arm or the resilient member will not interfere with the spring. Thus, the second connector can be pulled out easily and smoothly.

The connector assembly according to the present invention is especially suited for use with a high-reliability circuit. But it may also be used to fasten or lock seat belts and other belts, bands, cases and other articles for daily use.

Other features and objects of the present invention will become apparent from the following description made with reference to the accompanying drawings, in which:

DETAILED DESCRIPTION OF THE PREFERRED EMBODIMENT

Figure 1B:
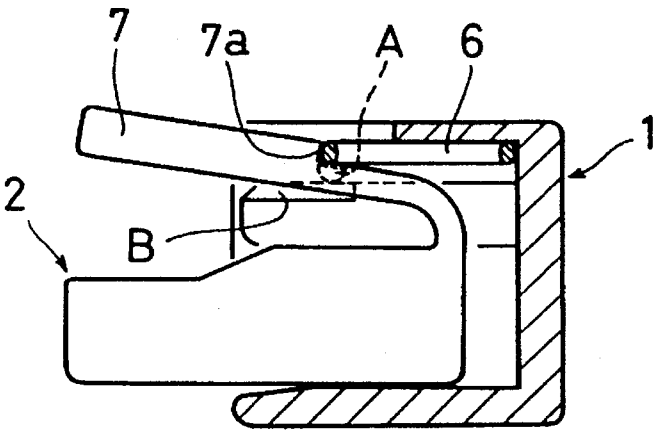
FIG. 1B is a view of the same showing the second connector being inserted into the first connector.

This connector assembly comprises a first connector 1 and a second connector 2 both made of a resin. A terminal end of a wire or the ferruled end of an optical fiber is connected to each connector along line C. But since they are not related to the point of the invention, they are not shown for clarity of the figure.

The first connector 1 comprises a socket-shaped connector housing having a groove 3 for receiving a locking arm 7 (described later), a slit 4 for preventing interference with the locking arm, protrusions B protruding into the groove 3 having predetermined length and thickness, and a spring 6 mounted in a groove 5 formed along the groove 3.

The second connector 2 has a connector housing to which is integrally connected the locking arm 7 having a free end, that is, a rear end with respect to the direction in which the second connector 2 is inserted into the first connector 1. The locking arm 7 has protrusions A formed on side surfaces thereof and adapted to interfere with the protrusions B when the second connector 2 is inserted in the first one 1.

The protrusions B have their rear ends tapered to guide the protrusions A upward when the second connector 2 is inserted into the first connector 1.

Figure 2A:
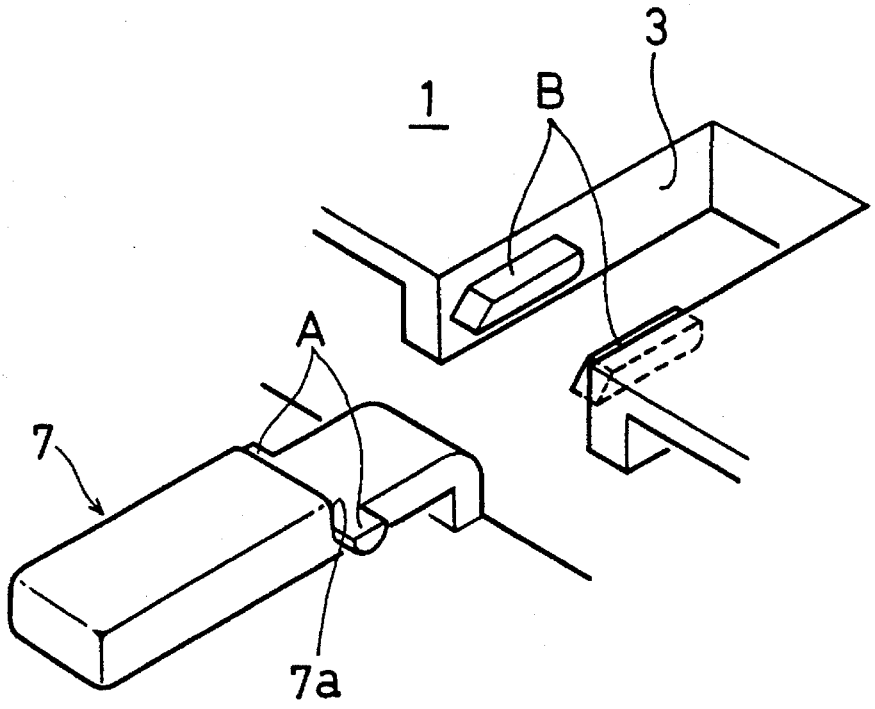
FIG. 2A is a perspective view of protrusions A and B in one arrangement.
Figure 2B:
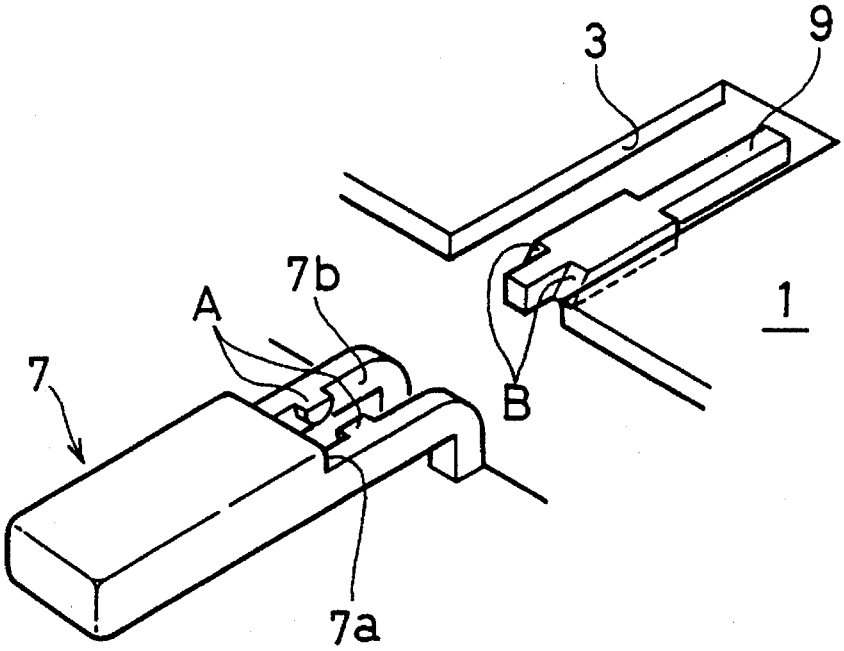
FIG. 2B is a perspective view of protrusions A and B in a modified arrangement.

The protrusions A may be formed on outer side surfaces of the lock arm 7 as shown in FIG. 2A, or on the inner side surfaces of a slit 7*b* formed in the locking arm as shown in FIG. 2B. Namely, the term "side surfaces of the locking arm" herein used refers to its inner or outer side surface.

If the locking arm 7 is of the type shown in FIG. 2B, the protrusions B are provided on both sides of a shaft 9 integral with the first connector 1 and adapted to be inserted into the slit 7*b*.

Figure 1A:
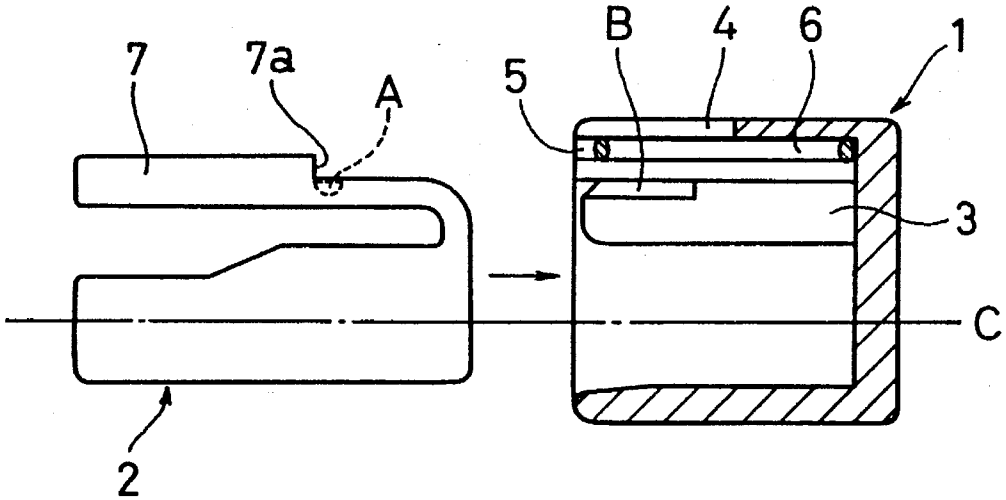
FIG. 1A is a partially cutaway front view of the connector assembly of the first embodiment.

In use, when inserting the second connector 2 into the first connector 1, the protrusions A and thus the locking arm 7 are guided up along the tapered surfaces of the protrusions B onto their top surfaces as shown in FIG. 1B. In this state, a shoulder portion 7*a* of the locking arm 7 abuts the rear end of the spring 6. By further pushing the second connector 2 into the first connector 1 from the position shown in FIG. 1B, the protrusions A will be moved further deep along the top surfaces of the protrusions B, whereas the spring 6 is compressed, so that its reactive force acts on both the first and second connectors 1 and 2. If the force urging the second connector 2 into the first connector 1 disappears before it is completely pushed into the first connector or if the insertion is incomplete, the second connector 2, urged by the spring 6, will be pushed back to the position shown in FIG. 1A, thereby notifying the operator of incomplete connection of the connectors.

Figure 1D:
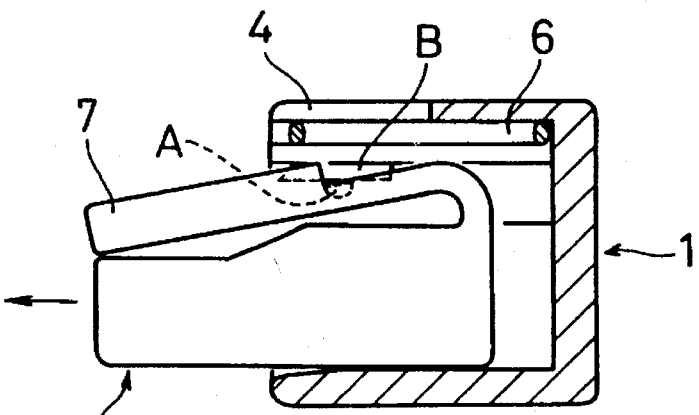
FIG. 1D is a view of the same showing the second connector being pulled out of the first connector.
Figure 1C:
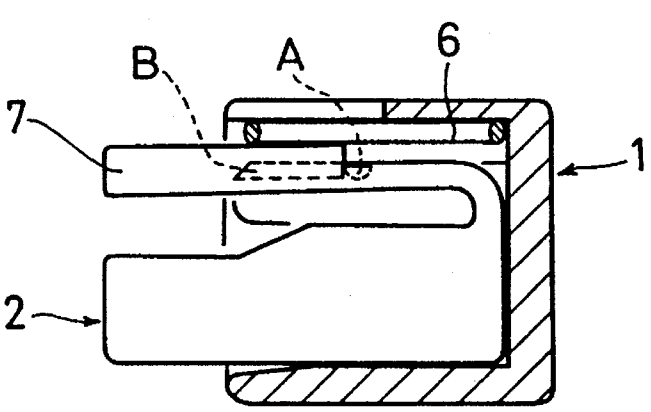
FIG. 1C is a view of the same showing the second connector fully inserted in the first connector.

In contrast, when the second connector 2 is pushed completely into the first connector 1, the protrusions A will get off from the top surfaces of the protrusions B, allowing the locking arm 7 to regain its original position as shown in FIG. 1C. At the same time, the spring 6, trapped in the groove 5, will disengage from the locking arm 7 and expand. In this state, the protrusions A engage the inner ends of the protrusions B, thereby preventing the separation of the connectors.

In order to disengage the connectors, the second connector 2 is pulled back while pushing down the free end of the locking arm 7 as shown in FIG. 1D. When the second connector is pulled back, the protrusions A can pass under the protrusions B, so that the spring 6 will not interfere with the locking arm 7, so that the second connector can be pulled out of the first connector without encountering resistance of the spring 6.

FIG. 3 shows the connector assembly of the second embodiment. It differs from the first embodiment in that the first connector 1 has an integral resilient arm 8 having small protrusions B similar to the protrusions A shown in FIG. 1, that the locking arm 7 has protrusions A having guide surfaces at their front ends for guiding the resilient arm 8 downward when the protrusions A abut the protrusions B, and that the spring 6 is mounted not in the first but in the second connector 2. But this embodiment functions in substantially the same way and achieves substantially the same effect as the first embodiment shown in FIG. 1.

Figures 3A, 3B, 3C, 3D:
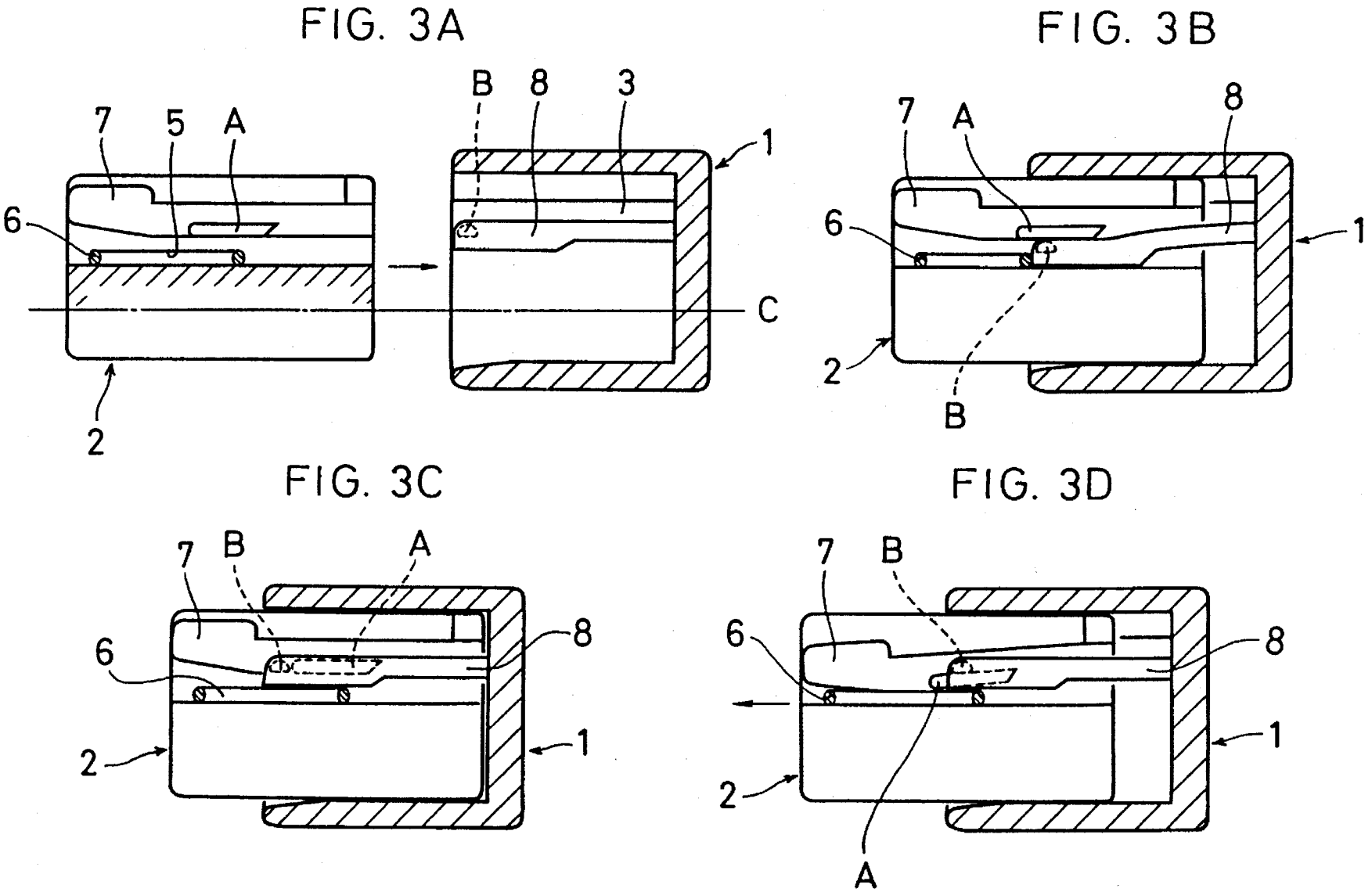
FIG. 3A is a partially cutaway front view of the connector assembly of the second embodiment.
FIG. 3B is a view of the same similar to FIG. 1B.
FIG. 3C is a view of the same similar to FIG. 1C.
FIG. 3D is a view of the same similar to FIG. 1D.

Namely, by inserting the second connector 2 into the first connector 1, the protrusions B are guided downward by the tapered surfaces of the protrusions A, so that the resilient arm 8 is pushed down and its rear free end engages the front end of the spring as shown in FIG. 3B. By further pushing the second connector into the first connector from this position, the spring 6 is compressed, so that its reactive force acts on the first and second connectors 1 and 2. Thus, if the connection is incomplete, the connectors will be pushed apart by the compressed spring 6. When the connectors are completely connected together, the protrusions B will get off from the bottom surfaces of the protrusions A allowing the resilient arm 8 to regain its original position as shown in FIG. 2C. At the same time, the spring 6 disengages from the locking arm 7 and expands. In this state, the protrusions A engage the inner ends of the protrusions B, thereby interlocking the connectors.

In order to disengage the connectors, the second connector 2 is pulled back while pushing down the free end of the locking arm 7 as shown in FIG. 2D. When the second connector is pulled back, the protrusions A pass under the protrusions B.

One advantage of this embodiment is that when inserting the second connector into the first connector, the free end of the locking arm will never rise upward, so that the slit 4 (FIG. 1) for preventing the interference with the locking arm does not have to be formed in the first connector.

The spring 6 may be a coil spring. But a wire spring or a thin leaf spring that has been deformed to produce repulsive force is more desirable because it requires lesser mounting space.

Figure 4:
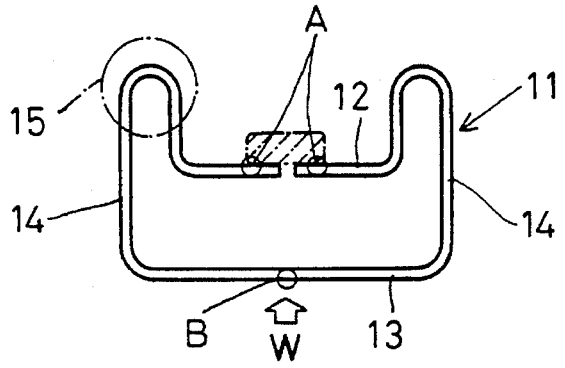
FIG. 4 is a plan view of a spring of one embodiment according the present invention.

FIG. 4 shows a spring which can be used as the spring 6 of the connector assembly according to this invention. It is formed by bending a linear spring material in a single plane so as to start from one end and end at the other end with both ends disposed close to each other. It comprises parallel transverse portions 12 and 13, parallel longitudinal portions 14 disposed at both ends of the transverse portions 12, 13, and U-shaped stress-absobing portions 15 formed by bending one end of each longitudinal portion 14 and connecting this end to the respective ends of the transverse portion 12. The spring 11 has a symmetrical configuration as a whole.

For higher repulsive force, the spring 11 is preferably formed from a spring steel. But it may be formed from any other ordinary spring material, including metals other than spring steel, resins, and composites of resins and reinforcing filaments.

As the spring 11, a wire spring is preferable because it occupies little space. But a strip of spring may be used unless it is too wide.

In the arrangement of FIG. 4, the stress-absorbing positions 15 are formed at the two corners of the spring that are farthest from the force application point B, which is at the center of the transverse portion 13. The wire shown in FIG. 5 has extra stress-absorbing portions 15 at the other ends of the longitudinal portions 14.

Figure 5:
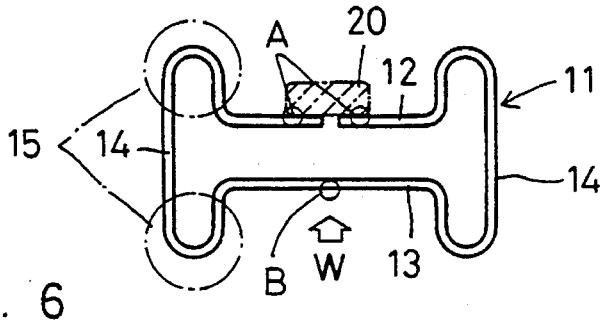
FIG. 5 is a plan view of a spring of another embodiment.

The springs shown in FIGS. 4 and 5 have their ends disposed at the center of the transverse portion 12 and supported at points A on a reaction force bearing member 20. With this arrangement, there is no need to connect one end of the spring to the other. But if the ends of the spring are welded or otherwise connected together, it is possible to position the point(s) of support A and the force application point B the other way around.

We conducted a characteristic test for these springs. In the test, we measured the spring constants of spring specimens having the same shapes as those shown in FIGS. 4–7, and the degree of residual deformation when they were displaced by 10 mm. The results are shown in Table 1.

TABLE 1

Figure 6:
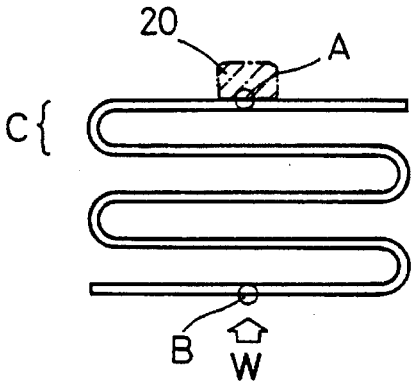
FIG. 6 PRIOR ART
FIG. 6 is a plan view of a conventional zigzag spring.
Figure 7:
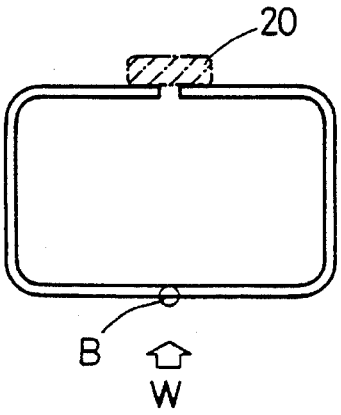
FIG. 7 PRIOR ART
FIG. 7 is a plan view of a conventional rectangular spring.

| | Spring constant (kgf/mm) | Residual deformation (mm) |
|---|---|---|
| Embodiment of FIG. 4 | 1.1 | 0.2 |
| Embodiment of FIG. 5 | 1.0 | 0.1 |
| Prior art spring of FIG. 6 | 0.3 | 0.3 |
| Prior art spring of FIG. 7 | 1.3 | 0.9 |

As will be apparent from these results, the springs according to the present invention had large spring constants while keeping low degrees of residual deformation.

The zigzag spring shown in FIG. 6 is so low in spring constant that it cannot reliably push back an article such as a connector to a desired position.

If this zigzag spring has a uniform section, when load W is applied, the maximum bending stress tends to concentrate on the point C, i.e. the point farthest from the load application point B. Thus, the force concentrated on point A can easily exceed the yield point of the spring even if the load applied is small.

This means that this spring is useless in applications in which large force is needed.

If a rectangular spring as shown in FIG. 7 is used in an attempt to disperse the maximum bending stress, bending stress will now concentrate on its four corners, so that the degree of residual deformation will increase to such an extent that the spring cannot push an object back to its original position if the spring is displaced (compressed) too much.

The spring according to the present invention is free of this disadvantage of the rectangular spring (that the degree of residual deformation is large at the corners) while preserving its advantages (that it is thin and high in spring constant). Thus, it shows high repulsive force and can bear a large displacement.

The spring according to the present invention is basically a rectangular spring with the U-shaped stress-absorbing portions added to some or all of its corners. When compressive load is applied to the transverse portions, the U-shaped stress-absorbing portions will narrow by resiliently deforming, so that stress is less likely to concentrate on the ends of the transverse portions. Thus, the degree of residual deformation at the corners can be reduced to a minimum. As a whole, the spring according to the present invention shows a larger repulsive force than the spring shown in FIG. 6 and can bear a larger displacement that the spring shown in FIG. 7.

What is claimed is:

1. A connector assembly comprising a first connector and a second connector having an integral, resiliently deformable locking arm and adapted to be inserted in said first connector, said locking arm having a shoulder portion and protrusions A on side surfaces thereof, said first connector having protrusions B on its surfaces that face said side surfaces when said second connector is inserted into said first connector, said protrusions B having top surfaces and bottom surfaces and being adapted to guide said protrusions A up onto said top surfaces when said second connector is inserted into said first connector, a spring mounted in said first connector and arranged so as to abut said shoulder portion of said locking arm when said protrusions A have been guided onto said top surfaces of said protrusions B, and to be compressed when said second connector is further pushed into said first connector, said protrusions A passing over said protrusions B and engaging inner ends of said protrusions B, and said shoulder portion disengaging from said spring when said second connector has been inserted completely into said first connector, said first connector having such a space as to allow said protrusions A to pass under said bottom surfaces of said protrusions B when said second connector is pulled out of said first connector while pressing down a free end of said locking arm.

2. A connector assembly comprising a first connector and a second connector having a resiliently deformable locking arm and adapted to be inserted in said first connector, said locking arm having protrusions A on side surfaces thereof, said first connector having an integral resilient arm provided with protrusions B on side surfaces thereof, said protrusions B being adapted to be pushed down by said protrusions A to allow passage of said protrusions A when said second connector is inserted into said first connector, a spring mounted in said second connector and arranged so as to abut one end of said resilient arm when said protrusions A have been pushed down by said protrusions B, and to be compressed when said second connector is further pushed into said first connector, said protrusions A passing over said protrusions B and engaging inner ends of said protrusions B, and said resilient arm disengaging from said spring when said second connector has been inserted completely into said first connector, said first connector having such a space as to allow said protrusions A to pass under said protrusions B when said second connector is pulled out of said first connector while pressing down a free end of said locking arm.

3. A connector assembly as claimed in claim 1, wherein said spring is a symmetrical member formed by bending a wire in a single plane and comprises two parallel transverse portions, one having a support point and the other having a force application point, two parallel longitudinal portions provided at both ends of said transverse portions, and U-shaped shock-absorbing portions provided at least at one end of said longitudinal portions and connecting with both ends of one of said transverse portions.

4. A connector assembly as claimed in claim 2, wherein said spring is a symmetrical member formed by bending a wire in a single plane and comprises two parallel transverse portions, one having a support point and the other having a force application point, two parallel longitudinal portions provided at both ends of said transverse portions, and U-shaped shock-absorbing portions provided at least at one end of said longitudinal portions and connecting with both ends of one of said transverse portions.

* * * * *